US008007219B1

(12) United States Patent
Wilkens et al.

(10) Patent No.: US 8,007,219 B1
(45) Date of Patent: Aug. 30, 2011

(54) SWEEP TARP

(76) Inventors: Arthur L. Wilkens, Stockton, KS (US); Timothy N. Martin, Ephrata, PA (US)

( * ) Notice: Subject to any disclaimer, the term of this patent is extended or adjusted under 35 U.S.C. 154(b) by 234 days.

(21) Appl. No.: 12/430,084

(22) Filed: Apr. 25, 2009

Related U.S. Application Data

(60) Provisional application No. 61/047,874, filed on Apr. 25, 2008.

(51) Int. Cl.
*B60P 1/00* (2006.01)

(52) U.S. Cl. ..... 414/527; 414/507; 414/509; 414/525.1

(58) Field of Classification Search ..... 414/507, 414/509, 525.1, 527, 812, 813
See application file for complete search history.

(56) References Cited

U.S. PATENT DOCUMENTS

| | | | |
|---|---|---|---|
| 6,033,179 | A | 3/2000 | Abbott |
| 6,974,296 | B2 | 12/2005 | Simrin |
| 2005/0042067 | A1 | 2/2005 | Simrin |
| 2006/0182576 | A1 | 8/2006 | Foster |

*Primary Examiner* — Michael S Lowe
(74) *Attorney, Agent, or Firm* — Robert L. Farris; Farris Law, P.C.

(57) ABSTRACT

The sweep tarpaulin has an upper sheath, a bottom sheath and an intermediate sheath. An upper tube is housed in the upper sheath. A lower tube is housed in the bottom sheath. An intermediate tube is housed in the intermediate sheath. The sides of the tarpaulin engage the container side walls. Left and right resilient members hold the upper tube in a loading position. The bottom sheath and the lower tube are supported on a reciprocating floor slat conveyor. Cargo and the lower tube move toward the rear during unloading. The left and right resilient members are deformed to release the upper tube. A winch returns the upper tube to the cargo receiving position. The left and right resilient members are deformed when the upper tube returns.

7 Claims, 7 Drawing Sheets

SWEEP TARP

CROSS REFERENCE TO RELATED APPLICATIONS

This application claims the benefit of the filing date of U.S. Provisional Application No. 61/047,874, titled SWEEP TARP, filed Apr. 25, 2008

TECHNICAL FIELD OF THE INVENTION

This invention relates cargo containers with reciprocating floor slat conveyors and more particularly a sweep tarp for sweeping particulate and granular materials from the floor slats at the same time the floor slats are reciprocated back and forth to unload a cargo container.

BACKGROUND OF THE INVENTION

Reciprocating floor slat conveyors are employed in cargo container bodies mounted on trucks as well as in trailers pulled by trucks. These conveyors are employed to improve efficiency and reduce the cost of moving bulk cargo by reducing the turn around time.

Cargo moved in containers, with reciprocating floor slat conveyors, includes agriculture products for human consumption as well as products for livestock consumption. Some products such as fodder for livestock stick together and substantially clean the upper surfaces of floor slats as the products are unloaded. A sweep to clean the cargo container is not required with these products. Products such as grains for human and livestock consumption tend to leave a layer of grain on each floor slat. It can take several minutes to manually sweep all the grain from floor slats that may be fifty feet long. If the cargo container is being unloaded several times per day the few minutes it takes to manually sweep the floor each time could reduce the number of loads transported per day.

A cargo container transporting the same cargo load after load could elect to forgo sweeping the floor slats. That election would result in transporting some cargo when returning for another load. Loading the cargo container with some cargo still in the container will reduce the quantity of cargo that is moved per trip. Over a period of time it could take several extra trips to transport the amount of cargo that would have been transported if the container had been emptied each time cargo was discharged. There is also the extra cost of transporting some cargo when the cargo container should be empty.

Some bulk cargo should not be contaminated with other cargo. Contamination such as mixing white beans with black beans is merely undesirable. Mixing grain for humans or livestock with a fertilizer for example could result in sick people or sick livestock.

The maximum weight that a cargo container can carry in one trip depends on the legal gross weight restrictions and the empty weight of the vehicle transporting the cargo. Transporting companies will pay a premium for cargo containers that will transport two or three hundred pounds of additional cargo per trip without a premature equipment failure. Prior to purchasing cargo containers, the cost of transporting the specific cargo that is generally transported, the distance the cargo is moved and other factors will be considered. One of the sweep tarps may or may not be purchased depending on the results of the calculations.

SUMMARY OF THE INVENTION

The sweep tarp assembly: includes a plate member adapted to be clamped to the front wall of a cargo container. A left vertical end plate is secured to the plate member and extends rearward from the plate member and away from the front wall. A right vertical end plate is secured to the plate member and extends rearward from the plate member and away from the front wall. A left resilient arm has a left base end anchored to said plate member outboard of the left vertical end plate and includes a left resilient arm portion extending upward and rearward from the left base to a left resilient arm free end. A right resilient arm has a right base end anchored to said plate member outboard of the right vertical end plate and includes a right resilient arm portion extending upward and rearward from the right base end to a right resilient arm free end.

A winch assembly includes a winch journaled on said plate member for rotation about a horizontal axis parallel to the front wall. A motor mounted on said plate member is between the left end plate and the right end plate and connected to the winch. The motor is operable to rotate the winch about the horizontal axis to wind a rope onto the winch. An idler spool is journaled on said plate member above the winch. The rope extends upward from the winch to the idler spool, between the plate member and the idler spool, over the top of the idler spool and then downward. A winch assembly cover plate is connected to the left vertical end plate and to the right vertical end plate.

A sweep tarpaulin has an upper sheath. A left side resilient arm aperture is in the upper sheath. A right side resilient arm aperture is in the upper sheath. A winch rope aperture is in the upper sheath mid way between the left side resilient arm aperture and the right side resilient arm aperture. A bottom sheath is provided on the tarpaulin. An intermediate sheath is between the upper sheath and the bottom sheath, a horizontal upper tube housed in the upper sheath, a horizontal lower tube housed in the bottom sheath and a horizontal intermediate tube housed in the intermediate sheath.

During loading of said cargo container the horizontal upper tube, is supported by the left side resilient arm with the left resilient arm free end extends through the left side resilient arm aperture. The right side resilient arm includes the right resilient arm free end extending through the right side resilient arm aperture. The lower tube in the bottom sheath is supported by said floor conveyor to the rear of said front end wall. The winch rope is secured to the horizontal upper tube through the winch rope aperture in the upper sheath;

During unloading of said cargo container the lower tube in the bottom sheath moves rearward with cargo. The upper tube and the upper sheath are pulled rearward and downward. The left side resilient arm and the right side resilient arm are deformed and release the upper tube. A left edge of the tarpaulin engages a left side wall of said cargo container. A right edge of said tarpaulin engages a right side wall of said cargo container.

After cargo is discharged, the motor is energized to rewind the rope on the winch, elevate the upper horizontal tube, and move the upper horizontal tube into engagement with the left resilient arm and into engagement with the right resilient arm. Continued upward movement of the upper horizontal tube deflects the left resilient arm free and deflects the right resilient arm free end upward until the left resilient arm free end and the right resilient arm free end snaps into a support positions under the upper horizontal tube.

BRIEF DESCRIPTION OF THE DRAWINGS

The presently preferred embodiments of the invention are disclosed in the following description and in the accompanying drawings, wherein.

DETAILED DESCRIPTION OF THE PREFERRED EMBODIMENT

Figure 1:
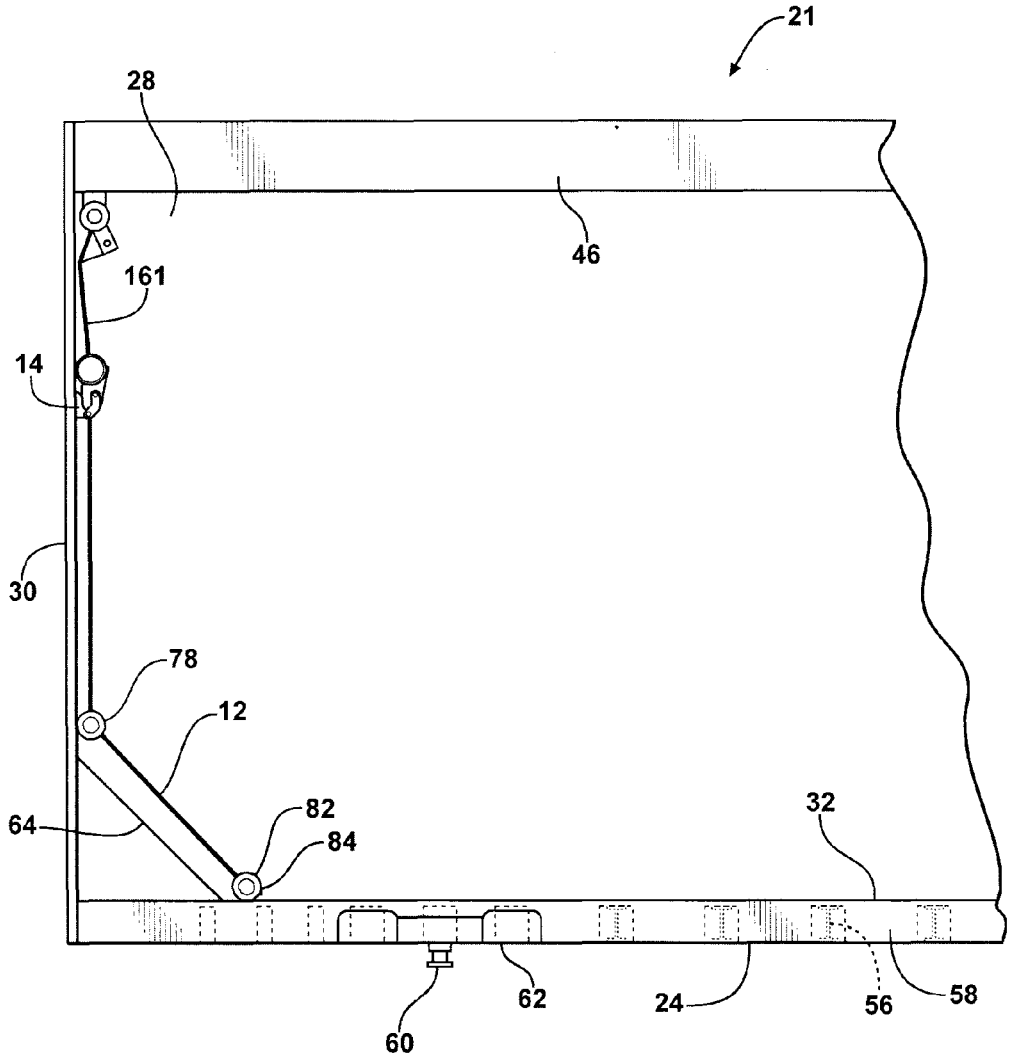
FIG. 1 is a schematic side vertical sectional view of the sweep tarp in a semi-trailer with the retraction housing removed to show the sweep tarp holder and parts broken away.
Figure 2:
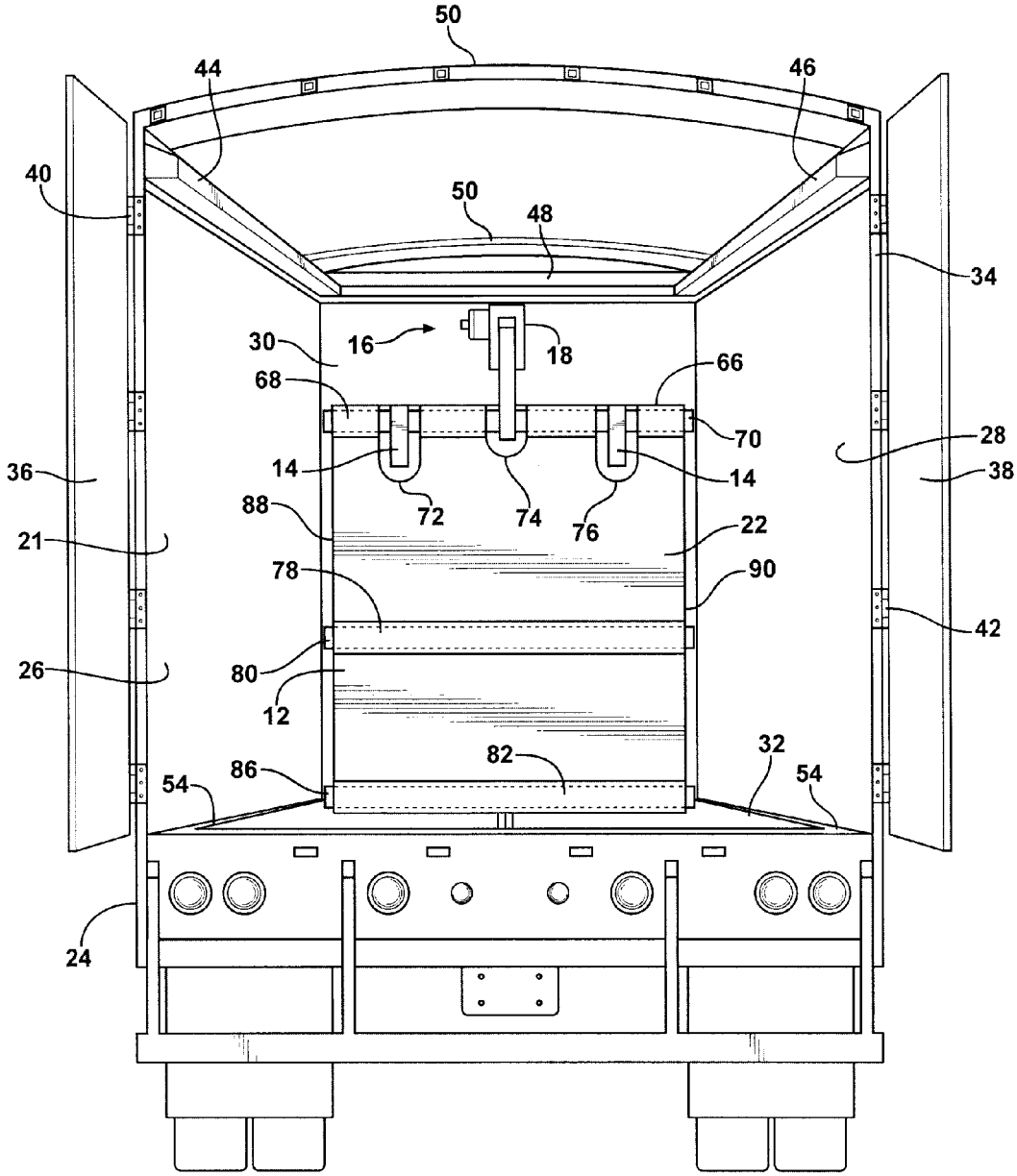
FIG. 2 is a schematic rear elevational view of a semi-trailer with the sweep tarp retained in a position for loading and the retractor housing removed.
Figure 3:
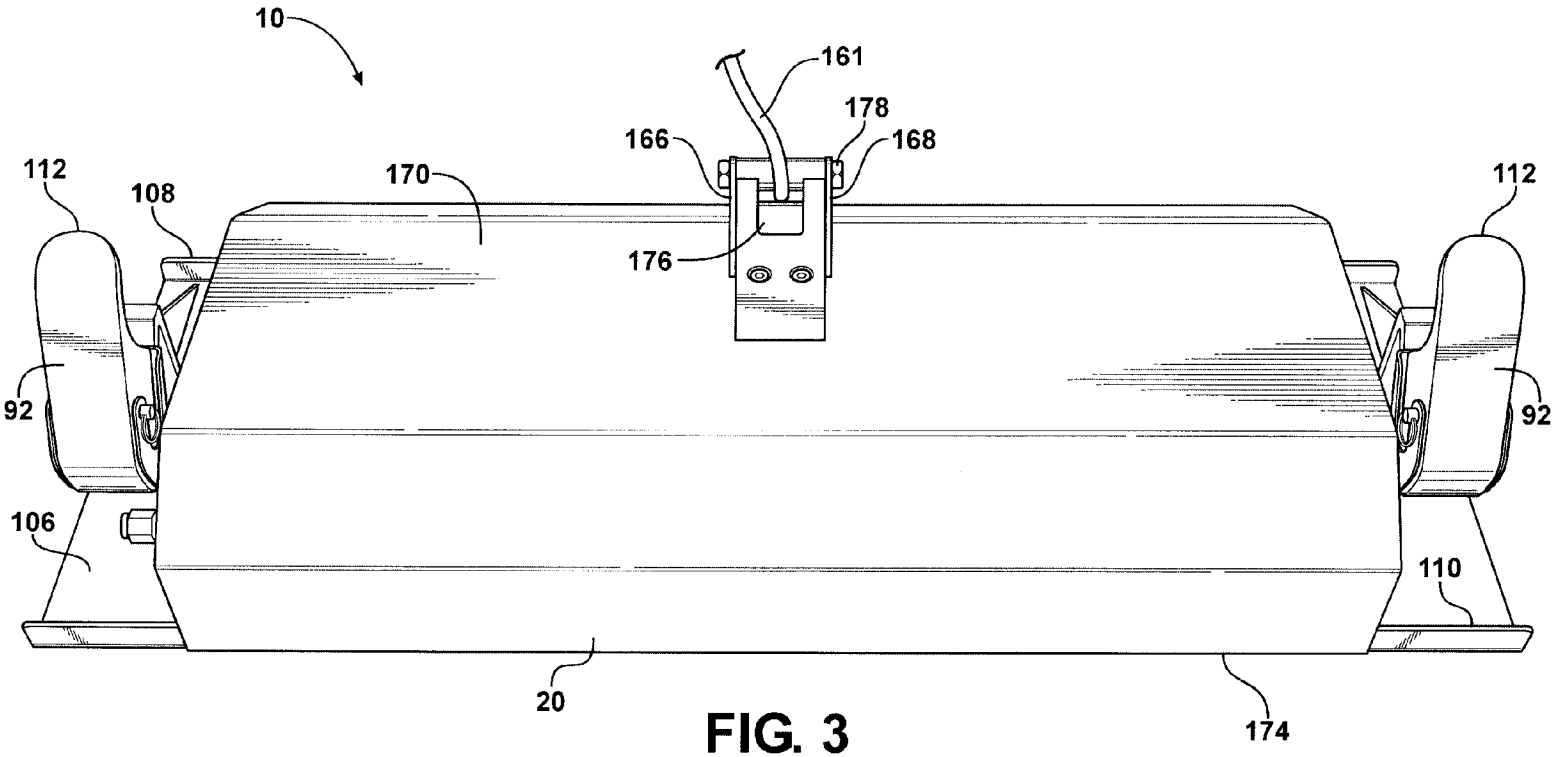
FIG. 3 is a perspective view of the bottom and rear of the sweep tarp retainer and winch housing cover.
Figure 4:
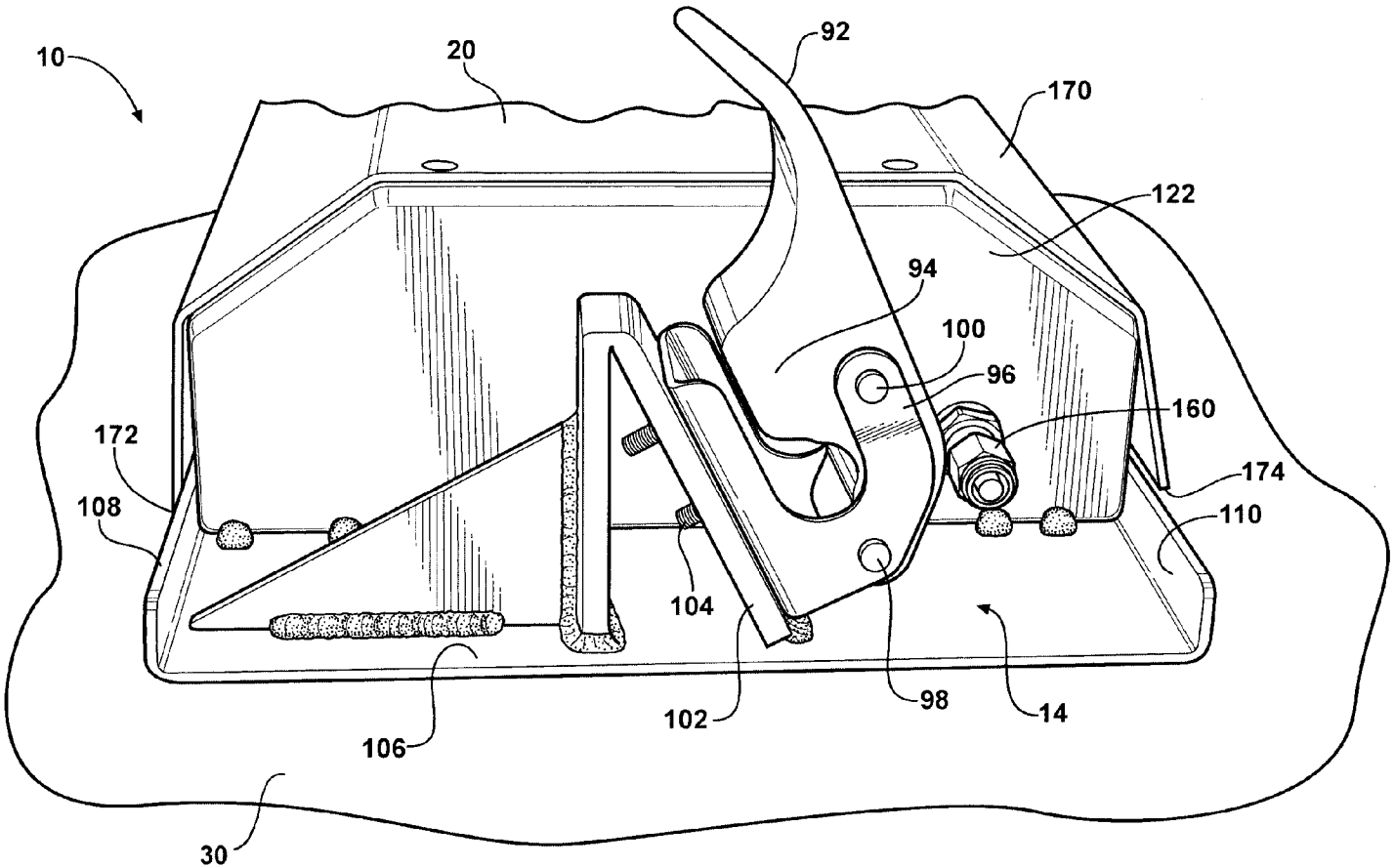
FIG. 4 is a perspective view of the left side and rear of the sweep tarp retainer and winch housing cover mounted on the front wall of a cargo container.
Figure 5:
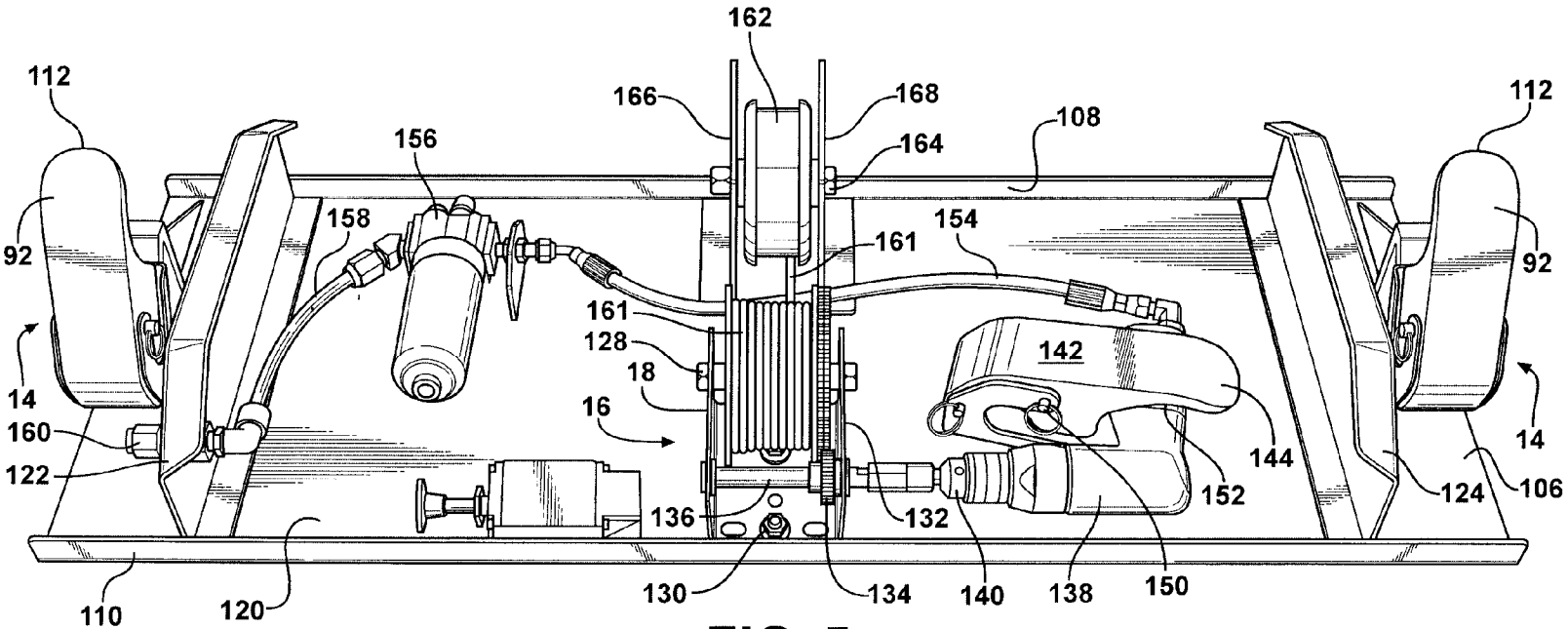
FIG. 5 is a perspective view similar to FIG. 3 with the winch housing cover removed.
Figure 6:
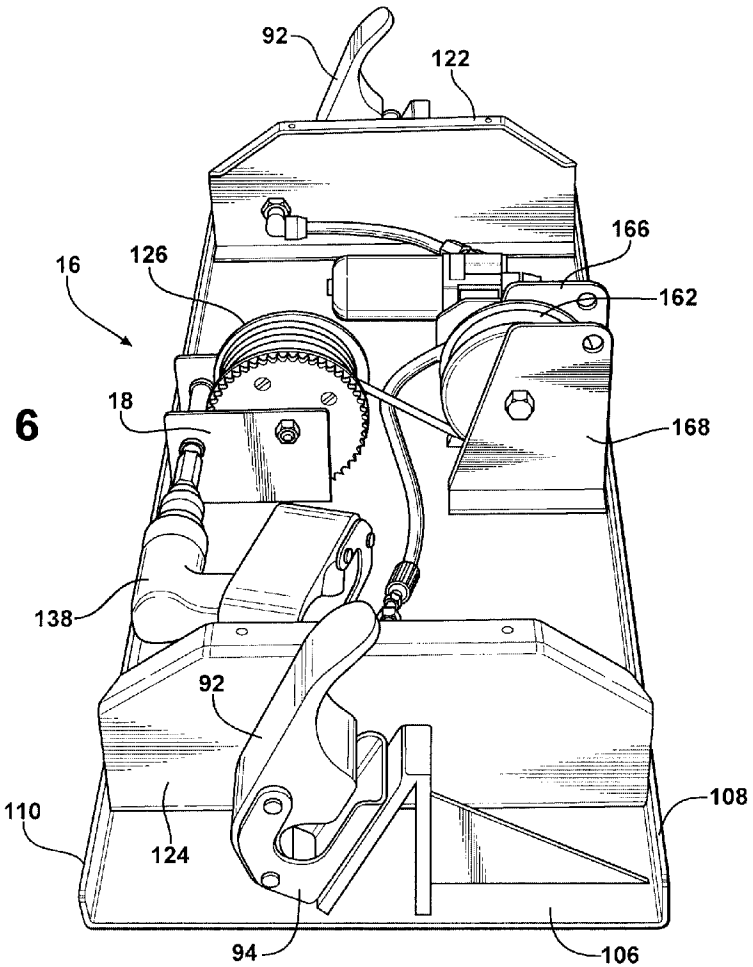
FIG. 6 is a side view of the right side and rear of the sweep tarp retainer and winch with the winch cover removed.
Figure 7:
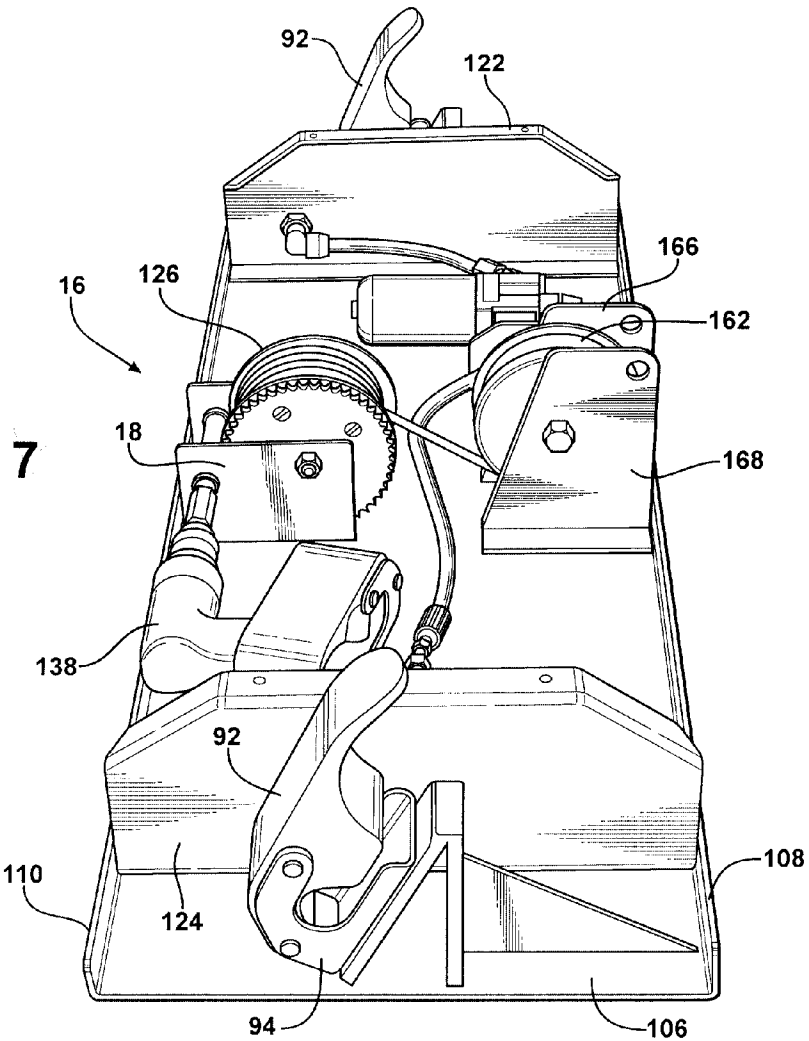

The sweep tarp retainer and winch assembly 10 includes a sweep tarp 12 a retainer system 14, a winch assembly 16, a winch 18 and winch housing cover 20. The sweep tarp 12 is mounted in a cargo container 21 of a semi-trailer 24 with a left side wall 26, a right side wall 28, a front wall 30 and a floor 32. A rear opening 34 can be closed by a left door 36 and a right door 38. The left door 36 is attached to the rear edge of the left side wall 26 by hinges 40. The right door 38 is attached to the rear edge of the right side wall 28 by hinges 42. The edge of the left side wall 26 is reinforced by a left upper beam 44. The upper edge of the right side wall 28 is reinforced by a right upper beam 46. The upper edge of the front wall 30 is reinforced by an upper front wall beam 48. Tarpaulin support beams 50 are secured to and supported by the top of the left side wall 26 and the top of the right side wall 28. The tarpaulin support beams 50 are removable for loading cargo into the cargo container 21 of a semi-trailer 24 if necessary. The floor 32 of the cargo container 22 includes a plurality of floor slats 54. The floor slats 54 are slideably supported by bearings 52 mounted on transverse I-beams 56. The transverse I-beams 56 have ends that are fixed to side rails 58 on the bottom edges of the left side wall 26 and the right side wall 28. A king pin 60 and a fifth wheel plate 62 are secured to the floor 32 of the semi-trailer 24 to the rear of the front wall 30. The king pin 60 is connectable to the fifth wheel of a tractor vehicle. The fifth wheel plate 62 of the semi-trailer 24 sits and slides on the fifth wheel of a tractor. Each floor slat 54 is generally about three inches wide and extends the length of the cargo container 21. A floor slat drive assembly (not shown) advances all of the floor slats 54 to the rear simultaneously and advances the cargo about twelve inches relative to rear opening 34 and away from the front wall 30. The floor slat drive assembly then moves every third floor slat 54 connected to a first transverse drive beam forward about twelve inches while the remainder of the floor slats remains stationary. A second transverse drive beam then moves the one third of the floor slats 54, on a first side of the floor slats connected to the first transverse drive beam, forward about twelve inches while the remainder of the floor slats remain stationary. A third transverse drive beam then moves the floor slats 54, that are not connected to the first drive beam or the second drive beam, forward about 12 inches while floor slats driven by the first and second drive beams remain stationary. A slant board 64 connected to the side walls 26 and 28 and the front wall 30 covers the front ends of the floor slats 54 and keeps cargo from entering the space between the front ends of the floor slats and the front end wall 30. The drive beams are then ready to have all the floor slats 54 moved simultaneously to the rear together with the cargo they support. The floor slats 54 continue to repeat the above steps until all of the cargo is discharged from the cargo container 21. There are a number of other slat drives that can be employed to reciprocate floor slats 54.

The sweep tarp 12 can be a tarp material 22 of polyester or nylon scrim embedded in vinyl or a sheet of net material. The net material is used for example to prevent sand from being blown from moving sand and gravel trucks. The tarp material 22 with a vinyl material prevents the passage of cargo with fine material and dust. The net material prevents the passage of most seeds and larger cargo particles and is relatively light weight. Sweep tarps 12 with tarp material 22 made from scrim embedded in vinyl as well as net material are both durable and flexible.

Sweep tarp 12 has an upper edge 66 with an upper sheath 68 formed by sewing or other procedures. An upper tube 70 is inserted into the sheath 68. Three apertures 72, 74 and 76 are provided in the sheath 68 to expose the upper tube 70. A center sheath 78 is formed in the sweep tarp 12. The center sheath 78 receives a center tube 80. A bottom sheath 82 is formed on the bottom edge 84 of the sweep tarp 12 by sewing or other procedures. A lower tube 86 is inserted into the bottom sheath 82. The center tube 80 and the bottom tube 86 are parallel to the upper tube 70. The upper tube 70, the center tube 80 and the lower tube 86 hold the left edge 88 of the sweep tarp 12 adjacent to the inside surface of the left side wall 26. The upper tube 70, the center tube 80 and the lower tube 86 also hold the right edge 90 of the sweep tarp 12 adjacent to the inside surface of the right side wall 28. The left edge 88 and the right edge 90 of the sweep tarp 12 are preferably in sealing contact with the adjacent side walls 26 and 28.

The retainer system 14 for holding the sweep tarp 12 in position adjacent to the front wall 30 of the cargo container includes two resilient arms 92 with embedded plates in their base ends 94. The base ends 94 of the resilient arms 92 are anchored to a rigid arm body 96 by a forward pin 98 and a rear pin 100. The rigid arm body 96 is clamped to a bar 102 by bolts 104. The bar 102 is secured to a plate member 106 with an integral upper flange 108 and an integral lower flanges 110. The plate member 106 is clamped to the inside surface of the front wall 30 of a cargo container by bolts. The upper flange 108 is parallel to and below the upper front wall beam 48. The plate member 106 is substantially vertical and parallel to the front wall 30. The bar 102 is welded to the plate member 106 so that it extends upward and rearward from the plate member. In this position the forward pin 98 and the rear pin 100 both have a horizontal transverse axes and these axes are spaces apart in horizontal plane. The horizontal plane, that includes the axes of the forward pin 98 and the rear pin 100, is perpendicular to the plate member 106 that supports the rigid arm body 96. The resilient arm 92 is held in a position, by the forward pin 98 and the rear pin 100, in which the resilient arm mid portion extends rearward and upward at an angle of about thirty degrees from horizontal. The free end 112 of the resilient arm 92 is curved upward from the thirty degree angle. The left retainer resilient arm 92 is mounted on the left end of the plate member 106 and the right retainer resilient arm 92 is mounted on the right end of the plate member and forms the retainer system 14. The free end 112 of the left retainer resilient arm 92 extends through the aperture 72 in the sweep tarp material 22, engages the upper tube 70 and urges the upper tube upward and forward. The free end 112 of the right retainer resilient arm 92 extends through the aperture 76 in the sweep tarp material 22, engages the upper tube 70 and urges the upper tube upward and forward. The left and right retainer resilient arms 92 and their holder members form the retainer system 14 and hold the sweep tarp 12 in a position for loading a cargo container 21.

The winch assembly 16 is mounted in a winch housing 120 formed by a left end plate 122 and a right end plate 124 secured to the plate member 106. The left retainer resilient arm 92 is outboard of the left end plate 122. The right retainer resilient arm 92 is outboard of the right end plate 124.

The winch assembly 16 includes a winch spool 126 journaled on a bolt 128 by bearings. The bolt 128 passes through a channel shaped winch housing 130. A driven spur gear 132 is attached to one side of the winch spool 126. A drive pinion 134 is mounted on a shaft 136 journaled on the winch housing 130. The drive pinion 134 meshes with the spur gear 132.

An Ingersoll Rand® air drill 138 with a chuck 140 drives the shaft 136 and the drive pinion 134. Air or motors drills 138 are available from other manufacturers. The air drill 138 can be replaced by an electric motor or by a hydraulic motor if desired. The power provided by an electric motor, a hydraulic motor or the air drill 138 can be selected to meet the demands of the trailer or van body in which the sweep tarp 12 is to be employed. A cargo container 21 that has a reduced inside width, height or length would most likely require less power for the winch 16. A holder assembly 142 retains the body of the air drill 138 and keeps the body of the drill from rotating. The holder assembly 142 includes a resilient arm 144 that is secured to a rigid arm body 146 by two pins 148 and 150. The resilient arm 144 of the holder assembly 142 engages the hand grip 152 of the air drill 138. Air under pressure is supplied to the air drill 138 by a flexible line 154. An inlet end of the flexible line 154 is connected to an air filter 156. Water, oil and other contaminants are separated from air by the air filter 156 to thereby supplying clean dry air to the air drill 138. An air line 158 is connected to a line fitting 160 mounted on the left end plate 122, and an inlet port of the air filter 156. The line fitting 160 is connected to a compressed air tank (not shown) of a vehicle brake system through a control valve. The air drill 138 drives the winch spool 126 in one direction only. There is no brake in the drive for the winch spool 126. Friction in the winch assembly and winch drive system is minimized.

A nylon rope 161 is wound on the winch spool 126. An idler spool 162 is journaled on a bolt 164 that passes through vertical plates 166 and 168 welded to the plate member 106. The nylon rope 161 extends up from the winch spool 126, around the front side of the idler spool 162 and out of the winch housing 120. A cover plate 170 is clamped to the left end plate 122 and the right end plate 124 by screws. A top edge 172 of the cover plate 170 is above the integral upper flange 108 of the plate member 106. A bottom edge 174 is below the integral lower flange 110.

The nylon rope 161 passes rearward over the top of the idler spool 162 and out of the winch housing 120, as stated above. A free end of the round nylon rope 161 is connected to the center of the upper tube 70. An arcuate plate 176 has a rear end pivotally attached to the left vertical plate 166 and the right vertical plate 168 by a bolt 178. The arcuate plate 176 extends forward and over the top of the idler spool 162 to retain the nylon rope 161 on the idler spool 162.

During operation a valve is opened to supply air through an air filter 156 to the air drill 138. Clean dry compressed air supplied to the air drill 138 rotates the winch spool 126 and winds up nylon rope 161. The upper tube 70 of the sweep tarp engages the resilient arms 92 of the retainer system 14. Both resilient arms 92 are forced upward until the upper tube 70 moves up above the free ends 112 of the resilient arms. The left arm 92 springs into the aperture 72 and the right arm 92 springs into the aperture 76 through sweep tarp 12. The air drill 138 is overloaded and stops when the upper tube 70 contacts the rear surfaces of the vertical plates 166 and 168. Closing the valve that supplies compressed air to the air drill releases torque on the winch spool 126. The weight of the sweep tarp 12 together with the upper tube 70 and the center tube 80 rotates the winch spool 126 in a direction to unwind the nylon rope 161 and lowers the upper tube 70 onto the upper surface of both resilient arms 92. The resilient arms 92 of the retainer system 14 hold the sweep tarp 12 in a cargo receiving position. In the cargo receiving position, the center tube 80 is slightly above the top of the slant board and the lower tube 86 is resting on the top of the floor slats 54 that form the floor 32.

Movement of all of the floor slats 54 to the rear together with cargo carried by the floor slats 54 carries the lower tube 86 rearward. Rearward movement of the lower tube 86 pulls down on the upper tube 70 and increases the force exerted on the resilient arms 92 by the upper tube 70. The winch spool 126 rotates freely to unwind the nylon rope 161 as the lower tube 86 is moved to the rear with the cargo. The resilient arms 92 bend as the lower tube 86 is moved reward by the floor conveyor and release the upper tube 70 from the retainer system 14.

As cargo is discharged through the rear opening 34, the sweep tarp 12 continues to move toward the rear opening 34 with the lower tube 86. The sweep tarp 12 sweeps the upper surface of the floor slats 54 and carries loose material along. Cargo particles fall off the sweep tarp 12 as the sweep tarp passes to the rear of the floor 32. Once the sweep tarp is free of cargo particles, air under pressure is supplied to the air drill 138, the nylon rope 161, with a round cross section, is rolled up on the winch spool 126 and the upper tube 70 is returned to the position supported on both resilient arms 92 as described above. The cargo container 21 is then ready to be filled with cargo again.

This disclosed embodiment is representative of a presently preferred form of the invention, but is intended to be illustrative rather than definitive thereof. The invention is defined in the claims.

We claim:

1. A sweep tarp for cleaning a cargo container with a left side wall, a right side wall, a front end wall with a front end wall center midway between the left side wall and the right side wall, a rear discharge opening, and a floor conveyor with reciprocating floor slats comprising:

a left side resilient arm, with a base end anchored to said front end wall between the left side wall and the front end wall center, and extending from the base end upward and away from the front end wall to a left resilient arm free end;

a right side resilient arm, with a base end anchored to said front end wall between the right side wall and the front end wall center, and extending from the base end upward and away from the front end wall to a right resilient arm free end;

a winch assembly attached to the front end wall and having a winch rope that extends from the winch assembly at a location directly to the rear of said front end wall center and above the left side resilient arm and the right side resilient arm;

a sweep tarpaulin with an upper sheath, a left side resilient arm aperture in the upper sheath, a right side resilient arm aperture in the upper sheath, a winch rope aperture in the upper sheath mid way between the left side resilient arm aperture and the right side resilient arm aperture, a bottom sheath, a center sheath between the upper sheath and the bottom sheath, a horizontal upper tube housed in the upper sheath, a horizontal lower tube housed in the bottom sheath, and a horizontal center tube housed in the center sheath;

wherein during loading of said cargo container the horizontal upper tube, is supported by the left side resilient arm with the left resilient arm free end extending through the left side resilient arm aperture, and by the right side resilient arm with the right resilient arm free end extending through the right side resilient arm aperture, the lower tube in the bottom sheath supported by said floor conveyor to the rear of said front end wall, the winch rope secured to the horizontal upper tube through the winch rope aperture in the upper sheath; and wherein during unloading of said cargo container the horizontal lower tube in the bottom sheath moves rearward with cargo, the upper tube and the upper sheath are pulled rearward and downward, and the left side resilient arm and the right side resilient arm are deformed and release the upper tube.

2. A sweep tarp, as set forth in claim 1, wherein the winch is driven by a winch drive to rewind the winch rope, after cargo is discharged, the horizontal upper tube engages the left side resilient arm and the right side resilient arm, forces the left and right resilient arms upward and the left resilient arm free end snaps into the left resilient arm aperture and the right resilient arm free end snaps into the right side resilient arm aperture.

3. A sweep tarp, as set forth in claim 2, wherein the winch drive is deactivated after the winch rope is wound up, the winch unwinds, due to the weight of the sweep tarp, and the horizontal upper tube, the horizontal upper tube engages the left side resilient arm and the right side resilient arm and is urged toward said front end wall.

4. A sweep tarp, as set forth in claim 1, wherein the left side resilient arm and the right side resilient arm simultaneously urge the horizontal upper tube toward said front end wall when the left side resilient arm and the right side resilient arm support the horizontal upper tube.

5. A sweep tarp, as set forth in claim 1, wherein the winch assembly is driven by an air drill.

6. A sweep tarp, as set forth in claim 5, wherein the air drill is retained by a holder assembly including a resilient arm.

7. A sweep tarp assembly comprising:

a plate member adapted to be clamped to the front wall of a cargo container, a left vertical end plate secured to the plate member and extending rearward from the plate member and away from the front wall, a right vertical end plate secured to the plate member and extending rearward from the plate member and away from the front wall, a left resilient arm having a left base end anchored to said plate member outboard of the left vertical end plate and including a left resilient arm portion extending upward and rearward from the left base to a left resilient arm free end, a right resilient arm having a right base end anchored to said plate member outboard of the right vertical end plate and including a right resilient arm portion extending upward and rearward from the right base end to a right resilient arm free end;

a winch assembly including a winch journaled on said plate member for rotation about a horizontal axis parallel to the front wall, a motor mounted on said plate member between the left end plate and the right end plate and connected to the winch and operable to rotate the winch about the horizontal axis to wind a rope onto the winch, a idler spool journaled on said plate member above the winch, wherein the rope extends upward from the winch to the idler spool, between the plate member and the idler spool, over the top of the idler spool and then downward, and a winch assembly cover plate connected to the left vertical end plate and to the right vertical end plate;

a sweep tarpaulin with an upper sheath, a left side resilient arm aperture in the upper sheath a right side resilient arm aperture in the upper sheath, a winch rope aperture in the upper sheath mid way between the left side resilient arm aperture and the right side resilient arm aperture, a bottom sheath, an intermediate sheath between the upper sheath and the bottom sheath, a horizontal upper tube housed in the upper sheath, a horizontal lower tube housed in the bottom sheath and a horizontal intermediate tube housed in the intermediate sheath;

wherein during loading of said cargo container the horizontal upper tube, is supported by the left side resilient arm with the left resilient arm free end extending through the left side resilient arm aperture, and by the right side resilient arm with the right resilient arm free end extending through the right side resilient arm aperture, the lower tube in the bottom sheath supported by said floor conveyor to the rear of said front end wall, the winch rope is secured to the horizontal upper tube through the winch rope aperture in the upper sheath;

wherein during unloading of said cargo container the lower tube in the bottom sheath moves rearward with cargo, the upper tube and the upper sheath are pulled rearward and downward, and the left side resilient arm and the right side resilient arm are deformed and release the upper tube, a left edge of the tarpaulin engages a left side wall of said cargo container and a right edge of said tarpaulin engages a right side wall of said cargo container; and wherein after cargo is discharged the motor is energized to rewind the rope on the winch, elevate the upper horizontal tube, move the upper horizontal tube into engagement with the left resilient arm and into engagement with the right resilient arm, deflect the left resilient arm free and deflect the right resilient arm free end upward until the left resilient arm free end and the right resilient arm free end snaps into a support positions under the upper horizontal tube.

* * * * *